US011871838B2

(12) United States Patent
Ben-David et al.

(10) Patent No.: US 11,871,838 B2
(45) Date of Patent: Jan. 16, 2024

(54) HEAT BRUSH WITH A BRISTLE STRUCTURE

(71) Applicant: IBEAUTY BRANDS, INC, Van Nuys, CA (US)

(72) Inventors: Liam Ben-David, Woodland Hills, CA (US); Zhi Yong Deng, Huizhou (CN)

(73) Assignee: IBEAUTY BRANDS, INC., Van Nuys, CA (US)

( * ) Notice: Subject to any disclaimer, the term of this patent is extended or adjusted under 35 U.S.C. 154(b) by 41 days.

(21) Appl. No.: 17/164,133

(22) Filed: Feb. 1, 2021

(65) Prior Publication Data

US 2022/0240660 A1 Aug. 4, 2022

(51) Int. Cl.
*A46B 15/00* (2006.01)
*A46B 9/02* (2006.01)

(52) U.S. Cl.
CPC ..... *A46B 15/003* (2013.01); *A46B 9/023* (2013.01); *A46B 9/028* (2013.01)

(58) Field of Classification Search
CPC ..... A46B 15/003; A46B 9/023; A46B 9/026; A46B 9/028; A46B 15/0016; A46B 2200/104
USPC ..... D4/136; 15/159.1, 160
See application file for complete search history.

(56) References Cited

U.S. PATENT DOCUMENTS

| | | | | |
|---|---|---|---|---|
| 4,329,567 | A * | 5/1982 | Kunz | A45D 1/18 219/244 |
| 4,486,915 | A | 12/1984 | Stewart et al. | |
| 5,479,951 | A | 1/1996 | Denebeim | |
| 5,519,912 | A | 5/1996 | Kawamura | |
| 5,522,408 | A | 6/1996 | Wiegner | |
| 5,771,904 | A | 6/1998 | Lange et al. | |
| 6,817,053 | B2 | 11/2004 | Nakamura | |
| 9,706,753 | B2 | 7/2017 | Moeller et al. | |
| 10,455,928 | B2 | 10/2019 | Kim | |
| 10,517,388 | B2 | 12/2019 | Perez et al. | |
| 2013/0055518 | A1* | 3/2013 | Jacob | A46D 1/02 15/207.2 |
| 2018/0125223 | A1* | 5/2018 | Exley | A45D 2/002 |
| 2018/0153294 | A1* | 6/2018 | Thomas | A45D 2/001 |
| 2018/0295978 | A1* | 10/2018 | Kim | A46D 1/0261 |
| 2020/0268136 | A1* | 8/2020 | Richmond | A46B 9/025 |
| 2021/0169210 | A1* | 6/2021 | Chu | A46D 1/0276 |

FOREIGN PATENT DOCUMENTS

EP 3666116 A1 6/2020

OTHER PUBLICATIONS

Amazon, https://www.amazon.com/Conair-INFINITIPRO-Detangling-Volumizer-detangling/dp/B084DRX9WV, p. 3, 2020.

* cited by examiner

*Primary Examiner* — Randall E Chin
(74) *Attorney, Agent, or Firm* — Knobbe Martens Olson & Bear LLP

(57) ABSTRACT

Aspects of the present disclosure include a heat brush with a handle and a base. The base includes a heating surface and a bristle that has a protrusion. The protrusion may have any of several structures. Other aspects are also described and claimed.

28 Claims, 4 Drawing Sheets

HEAT BRUSH WITH A BRISTLE STRUCTURE

FIELD

The disclosure here relates to aspects of a heat brush, namely bristle structures on a heat brush. Other aspects are also described.

BACKGROUND

For as long as hair has been cultivated as an outward display of health, wealth, status, beauty, or other indicator of social standing, hair tools have existed to aid in cultivating said hair. These tools range in complexity from very simple combs and brushes all the way to with built-in lasers to stimulate hair growth. Each tool has a specific purpose and its own pros and cons.

One example of a hair tool is a heat brush, alternatively known as a straightening brush, smoothing brush, and hot brush. A heat brush applies heat to hair while the hair is being brushed. The heat brush may be a replacement for or supplement to a variety of other tools, such as a hair straightener, blow dryer, and brush. The heat brush allows a user to evenly apply heat to wet hair in a manner that may be faster or easier than with these other devices.

SUMMARY

A heat brush combines elements of a hair straightener with elements of a hair brush. A hair brush is intended to allow a user to pass bristles on the hairbrush easily through hair, such as for detangling. If the hair were to get caught within the hairbrush, it could lead to painful tugs, or worse, and so it is desirable for a hairbrush to minimize any chance of creating snags. A heat brush, meanwhile, is most effective when the heating element is able to maintain contact with the hair for as long as possible.

Aspects of the present disclosure are directed toward a heat brush with a bristle structure. The heat brush includes a handle and a base. The base includes a heating surface and a cover. The heating surface directs heat from heating coils and to hair through projections that are connected to the heating surface. The heat brush also includes bristles that are arranged around the heating surface.

Each bristle may include a body, a tip, and a protrusion. The protrusion may take the form of a ridge that is roughly triangular, although other configurations are considered. Each bristle may include multiple protrusions. In an aspect of the disclosure, the bristle includes an upper protrusion and a lower protrusion, with each protrusion arranged on a different side of the bristle.

In an aspect, other protrusion configurations are considered. The protrusion may extend straight outward from the body, such as in a downward direction toward the heating surface. The protrusions may extend in an upward direction away from the heating surface. The protrusions may extend outward from the body in a direction that is substantially parallel to the heating surface. The protrusions may take a hook form.

The protrusions act as a hair retention system, keeping the hair close to the heating surface during use by trapping the hair between the protrusion and the heating surface while the hair passes through the brush so that the hair is unable to easily fall away from the brush face. This helps the heat brush transfer heat to the hair more effectively.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
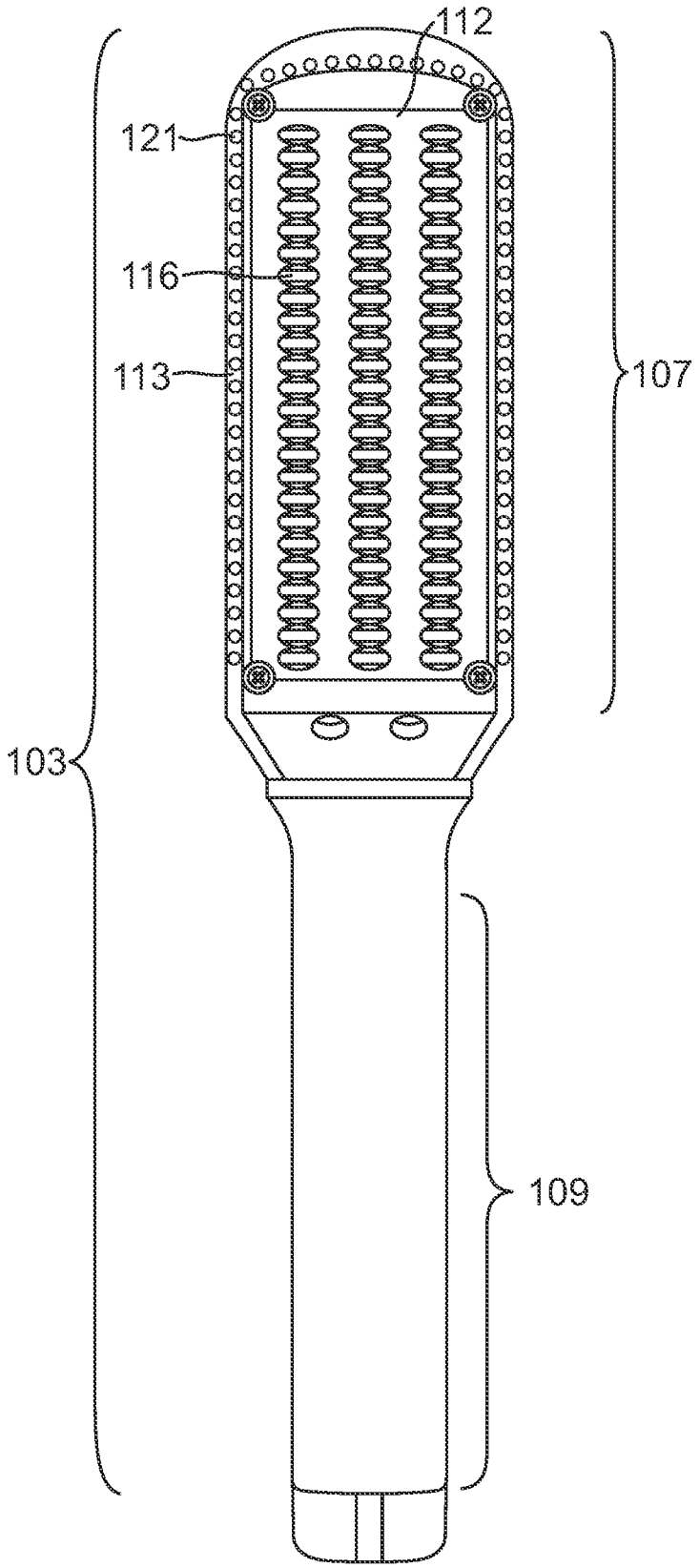
FIG. 1 illustrates an exemplary configuration of a heat brush.

An aspect of the present disclosure is directed toward a hairbrush with a heating element. FIG. 1 demonstrates an exemplary illustration of the heat brush 103, herein referred to as the heat brush, hairbrush, or brush. The hairbrush 103 may include a base portion 107 that is connected to a handle 109. The handle 109 may be made from a material that is not thermally conductive, such as plastic or rubber, so as to shield the hand of the user from heating during operation of the hairbrush 103. The handle 109 may be hollow, allowing necessary electronics to be contained within the handle 109. For instance, the handle 109 may contain a heater that produces or transfers heat; a processor; a user interface which may include components such as buttons and switches on an exterior surface (not shown) that allow a user to manipulate digital and analog components of the functionality of the brush, such as raising and lowering the amount of heat that the brush produces; electrical components, such as a power source, including an internal or externally stored battery, or components that may transform attributes of electricity received from an external source, such as the power grid; and other components that may be part of the functionality of the brush 103. Any or all of these elements may be stored within other parts of the heat brush 103 as well, such as within the base 107. The heater may be any of a known variety, such as an electric heater, which turns electrical resistance into heat.

The base 107 may include the functional elements of the heat brush 103, i.e., the elements that are used to brush and/or to heat the hair during use. For instance, the base 107 may include a heating surface 112. The heating surface 112 may cover substantially all of the inner face of the base 107, or a smaller portion of the inner face of the base 107 therein. The heating surface 112 may be formed from a material with thermally conductive properties, such as a ceramic, porcelain, and steel. The heating surface 112 may include a plurality of projections 116 that extend outward from the heating surface 112. The projections 116 may be arranged in rows and columns, concentrically, or by any number of patterns and arrangements. The projections 116 may be uniformly distributed throughout the heating surface 112 or arranged in dusters or patterns. In the illustration, the projections 116 are shown to be in three substantially parallel columns. The projections 116 may be formed from a thermally conductive material. In an aspect, the projections 116 may be formed as part of the heating surface 112. For instance, in an embodiment where the heating surface 112 is formed of ceramic, the heating surface 112 and the projections 116 may be formed within a single mold so that the heating surface 112 and projections 116 are composed of a single-body piece of ceramic. In another example, the projections 116 may include a heating element and a protective element. The projections 116 are intended to transfer heat to the hair of the user during operation, and it is desirable to avoid transferring heat to the scalp of the user, so the protective element may create a buffer between the scalp and the heating element. The protective element may form a shell around the exterior edges of the heating element and may be formed from a material with low thermal conductivity, such as rubber. In an embodiment, the projections 116 may be attached to the heating surface 112. For instance, the projections 116 may screw into the heating surface 112, or be fastened to the heating surface 112 by any of known means.

The base may also include a cover portion 113. The cover 113 may be made from a material that is a poor heat conductor, such as plastic or rubber. It may contain an inner coating or layer that is heat resistant, substantially preventing heat from transferring to or through the cover 113. The base 107 may include a plurality of bristles 121 that are arranged outside of the heating surface 112. For example, the bristles 121 may be arranged substantially around the perimeter of the heating surface 112, such that the bristles 121 substantially surround the heating surface 112. The bristles 121 may be formed from a sufficiently sturdy material, such as plastic or metal. The bristles 121 may be attached to or formed as part of cover 113. Other arrangements may be considered without straying from the inventive concept; for instance, the bristles 121 may be attached to or formed as part of the heating surface 112.

Figure 2:
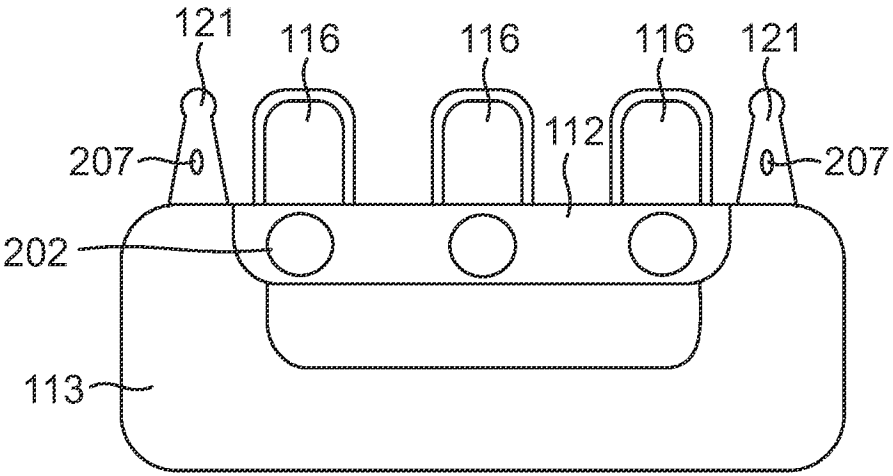
FIG. 2 illustrates a cross section of an exemplary heat brush.

FIG. 2 illustrates a cross section of the brush 103. In an aspect of the disclosure, the heat brush 103 may include a heat coil 202 that transmits heat to the projections 116. The illustration includes three heat coils 202 that are parallel and run from the handle 109 toward the base 107, although other configurations are possible. The heat coils 202 may produce or carry heat that is transferred to the projections 116, such as via the heating surface 112. The bristle 121 is shown to have a protrusion 207 that is located on a side of the bristle 121 structure.

Figure 3:
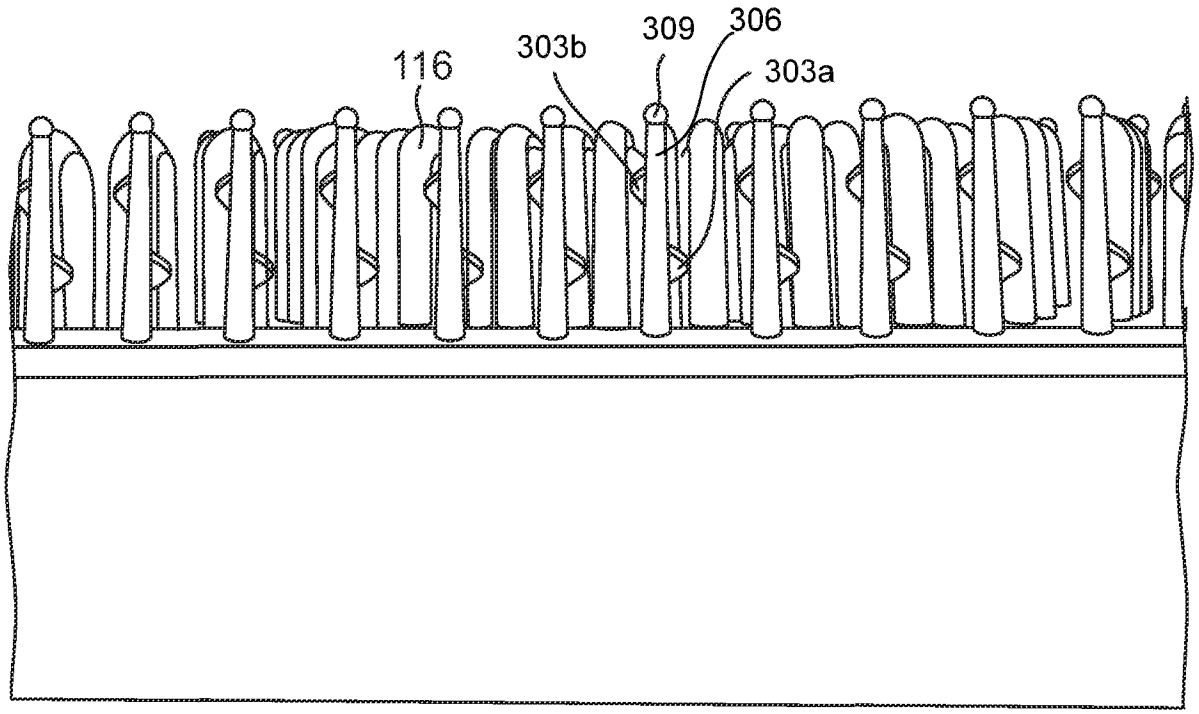
FIG. 3 illustrates a side view of an exemplary heat brush

FIG. 3 demonstrates a cut-away of a side view of an exemplary heat brush 103. An aspect of the present disclosure is directed toward a bristle 121 structure for promoting hair to stay in thermal contact with the heating surface 112 of the heat brush 103. The bristle structure 121 may include a body 306, a tip 309, and protrusions 303*a* and 303*b*. The body 306 may be slender and cylindrical. The body 306 may be attached to the heat brush 103, such as to the heating surface 112 or the cover 113, on a proximal end of the body 306. The tip 309 may be spherical and have a wider diameter than the diameter of the body 306. The tip 309 may be attached to the body 306 on a distal end of the body 306. The circumference of the body 306 may narrow closer to the tip 309, such as to create a sloping effect. The protrusions 303*a*, 303*b* may be located on the body and may extend from the body 306 in a direction that is substantially perpendicular to the body 306. In an aspect of the disclosure, the protrusions 303*a*, 303*b* may take the form of a ridge that is roughly triangular and narrow. In the illustration, each bristle structure 121 is shown to include two protrusions 303*a*, 303*b*, with a lower protrusion 303*a* located approximately ⅓ of the length of the body 306 from the proximal end of the body 306 and an upper protrusion 303*b* located approximately ⅓ of the length of the body 306 from the distal end of the body 306. The lower protrusion 303*a* and the upper protrusion 303*b* are shown to be on substantially opposing sides of the body, such that the lower protrusion 303*a* is oriented in a first direction, such as toward the handle, and the upper protrusion 303*b* is oriented in a second direction, such as away from the handle.

Figure 4A:
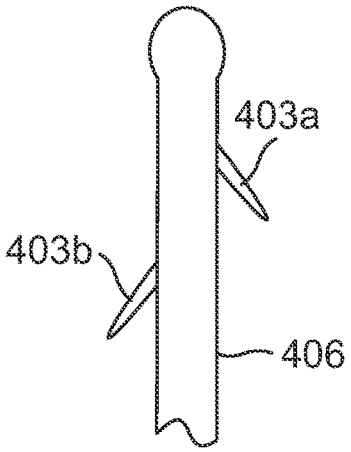
FIG. 4A-D illustrates various exemplary configurations of a bristle structure for a heat brush.
Figure 4B:
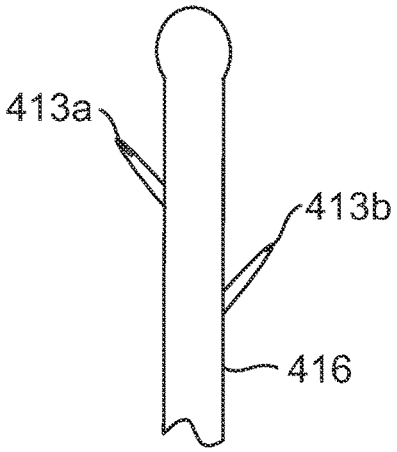
Figure 4C:
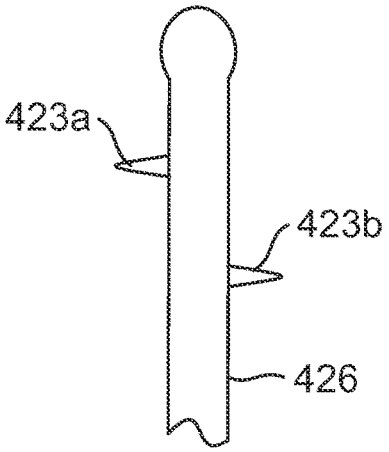
Figure 4D:
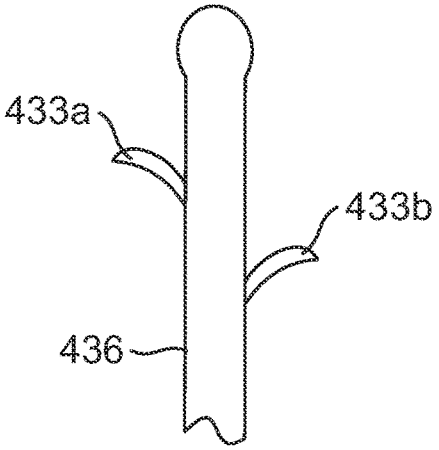

The number of protrusions 303*a*, 303*b*, orientations of the protrusions 303*a*, 303*b*, and location of the protrusions 303*a*, 303*b* shown is for illustrative purposes and should not be deemed limiting. It is conceivable that the body may include additional protrusions 303*a*, 303*b*, or that the protrusions 303*a*, 303*b* may be located at different locations on the body 306 of the bristle structure 121, or that the protrusions 303*a*, 303*b* may have different orientations from those shown. For instance, the protrusions 303*a*, 303*b* may be oriented in one direction, have various structural shapes across the heat brush 103, and any given bristle 121 may have any number of protrusions 303*a*, 303*b*. FIG. 4A-D demonstrates aspects of the disclosure that are directed toward different structures for the bristle 121. For instance, FIG. 4A demonstrates that the protrusions 403*a*, 403*b* may extend straight outward from the body 406, such as in a downward direction toward the heating surface 112. FIG. 4B demonstrates that the protrusions 413*a*, 413*b* may extend in an upward direction away from the heat brush 103. FIG. 4C demonstrates that the protrusions 423*a*, 423*b* may extend outward from the body 426 in a direction that is substantially parallel to the heating surface 112. In the embodiment demonstrated in FIG. 4D, the protrusions 433*a*, 433*b* may take a hook form, such that the protrusion extends from a side of the body 436 and arcs in an upward direction (away from the heating surface 112), a downward direction (towards the heating surface 112), or in a combination of an upward and downward direction, such as, for example, that the protrusions 433*a*, 433*b* may arc away the heating surface 112 at a proximal end of the protrusions 433*a*, 433*b* and the protrusions 433*a*, 433*b* may arc toward the heating surface 112 at a distal end of the protrusions 433*a*, 433*b*.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, while FIG. 1 depicts a device in which the heat brush 103 is primarily rectangular in shape, it is also possible to have a heat brush 103 that is more ovoid or circular in shape. The description is thus to be regarded as illustrative instead of limiting.

What is claimed is:

1. A heat brush, comprising:
a handle, and
a base connected to the handle, wherein the base comprises:
a heating surface, and
a plurality of bristles arranged around a perimeter of the heating surface,
wherein each of the plurality of bristles comprises:
a lower protrusion proximate to a proximal end; and
an upper protrusion proximate to a distal end, and
wherein the lower protrusion and the upper protrusion on each of the plurality of bristles extend outward from the bristle in a downward direction toward the heating surface.

2. The heat brush of claim 1, further comprising a third protrusion on each of the plurality of bristles.

3. The heat brush of claim 1, wherein each of the plurality of bristles is formed of plastic.

4. The heat brush of claim 1, wherein the upper protrusion is positioned opposite the lower protrusion on each of the plurality of bristles.

5. A heat brush, comprising:
a handle; and
a base connected to the handle, wherein the base comprises:
a heating surface, and
a plurality of bristles arranged around a perimeter of the heating surface,
wherein each of the plurality of bristles comprises:
a lower protrusion proximate to a proximal end, and
an upper protrusion proximate to a distal end, and
wherein the lower protrusion and the upper protrusion on each of the plurality of bristles extend outward from the bristle in an upward direction away from the heating surface.

6. The heat brush of claim 5, wherein the upper protrusion is positioned opposite the lower protrusion on each of the plurality of bristles.

7. The heat brush of claim 5, further comprising a third protrusion on each of the plurality of bristles.

8. The heat brush of claim 5, further comprising a heat coil disposed within the base and configured to provide heat to the heating surface.

9. A heat brush, comprising:
a handle; and
a base connected to the handle, wherein the base comprises:
a heating surface, and
a plurality of bristles arranged around a perimeter of the heating surface,
wherein each of the plurality of bristles comprises:
a lower protrusion proximate to a proximal end, and
an upper protrusion proximate to a distal end, and
wherein the lower protrusion and the upper protrusion on each of the plurality of bristles have a hook form.

10. The heat brush of claim 9, wherein each of the lower protrusions is located approximately ⅓of the length from the proximal end of each of the plurality of bristles and each of the upper protrusions is located approximately ⅓of the length from the distal end of each of the plurality of bristles.

11. The heat brush of claim 9, wherein the lower protrusion on each of the plurality of bristles extends outward from the bristle in a downward direction or in an upward direction toward the heating surface.

12. The heat brush of claim 9, wherein the upper protrusion on each of the plurality of bristles extends outward from the bristle in a downward direction or in an upward direction toward the heating surface.

13. A heat brush, comprising:
a handle; and
a base connected to the handle, wherein the base comprises:
a heating surface, and
a plurality of bristles arranged around a perimeter of the heating surface,
wherein each of the plurality of bristles comprises:
a lower protrusion proximate to a proximal end,
an upper protrusion proximate to a distal end, and
a spherical tip at the distal end on each of the plurality of the bristles.

14. The heat brush of claim 13, wherein the lower protrusion and the upper protrusion on each of the plurality of bristles extend outward from the bristle in a direction that is substantially parallel to the heating surface.

15. The heat brush of claim 13, wherein each of the plurality of bristles is formed of plastic.

16. The heat brush of claim 13, further comprising a heat coil disposed within the base and configured to provide heat to the heating surface.

17. A heat brush, comprising:
a handle; and
a base connected to the handle, wherein the base comprises:
a heating surface, and
a plurality of bristles arranged around a perimeter of the heating surface,
wherein each of the plurality of bristles comprises:
a lower protrusion proximate to a proximal end, and
an upper protrusion proximate to a distal end;
wherein the lower protrusion and the upper protrusion each have a triangular shape.

18. The heat brush of claim 17, wherein the lower protrusion and the upper protrusion are ridges that extend from the bristle.

19. The heat brush of claim 17, wherein each of the lower protrusions is located approximately ⅓of the length from the proximal end of each of the plurality of bristles and each of the upper protrusions is located approximately ⅓of the length from the distal end of each of the plurality of bristles.

20. The heat brush of claim 17, wherein the upper protrusion is positioned opposite the lower protrusion on each of the plurality of bristles.

21. A heat brush, comprising:
a handle; and
a base connected to the handle, wherein the base comprises:
a heating surface, and
a plurality of bristles arranged around a perimeter of the heating surface,
wherein each of the plurality of bristles comprises:
a lower protrusion proximate to a proximal end, and
an upper protrusion proximate to a distal end; and
a plurality of projections, wherein each of the plurality of projections extends from the heating surface and is configured to transfer heat, and wherein each of the plurality of projections is positioned on the heating surface in a series of rows.

22. The heat brush of claim 21, wherein each of the plurality of projections has a cylindrical shape.

23. The heat brush of claim 21, wherein each of the plurality of projections is formed within the perimeter of the heating surface.

24. The heat brush of claim 21, further comprising a heat coil disposed within the base and configured to provide heat to the heating surface.

25. A heat brush, comprising:

a handle; and a base connected to the handle, wherein the base comprises:

a heating surface, and a plurality of bristles arranged around a perimeter of the heating surface, wherein each of the plurality of bristles comprises:

a lower protrusion proximate to a proximal end, and an upper protrusion proximate to a distal end, and wherein each of the plurality of bristles has a first circumference at the distal end that is smaller than a second circumference at the proximal end.

26. The heat brush of claim 25, further comprising a first heat coil disposed within the base and configured to provide heat to the heating surface.

27. The heat brush of claim 26, further comprising a second heat coil positioned parallel to the first heat coil.

28. The heat brush of claim 27, further comprising a third heat coil positioned parallel to the first heat coil and the second heat coil.

* * * * *